US006287399B1

(12) United States Patent
Urushiyama

(10) Patent No.: US 6,287,399 B1
(45) Date of Patent: Sep. 11, 2001

(54) METALLIC ARTICLE RESISTANT TO BUCKLING

(75) Inventor: Yuta Urushiyama, Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/181,214

(22) Filed: Oct. 27, 1998

(30) Foreign Application Priority Data

Oct. 29, 1997 (JP) ..... 9-296510

(51) Int. Cl.[7] ..... C21D 1/00
(52) U.S. Cl. ..... 148/563; 148/676; 148/902
(58) Field of Search ..... 148/563, 676, 148/902

(56) References Cited

U.S. PATENT DOCUMENTS 4,450,616 * 5/1984 Morita ..... 29/446
5,611,874 * 3/1997 Zadno-Azizi et al. ..... 198/402
5,958,154 * 9/1999 O'Handley et al. ..... 148/312

* cited by examiner

*Primary Examiner*—George Wyszomierski

(57) ABSTRACT

Disclosed is an elongated metallic article having a curved section therein which has a first part formed on an outside part of the curved section, and a second part formed on an inside part of the curved section. The first part was initially deformed beyond a region of twin boundary deformation, but was thereafter returned to the region of twin boundary deformation. The second part was left deformed beyond the region of twin boundary deformation. When a compressive load is applied to the thus prepared article, and the first part and the second part are both compressed, the first part can deform more readily than the second part so that the article deforms into a more straight shape as its deformation progresses. Thus, the article may be made resistant to buckling in spite of the presence of the curved section.

7 Claims, 4 Drawing Sheets

METALLIC ARTICLE RESISTANT TO BUCKLING

TECHNICAL FIELD

The present invention relates to a metallic article including a curved section which is resistant to buckling, and a method for manufacturing such a metallic article.

BACKGROUND OF THE INVENTION

When a compressive force is applied to a metallic member having a curved section in a chord-wise direction, it tends to buckle substantially more readily than a similar member which is straight in the axial direction, and has no such curved section. To prevent the buckling and eventual destruction of such a member, it has been customary to increase the cross sectional area of the curved section and to add a reinforcement such as a rib to the curved section.

However, such measures inevitably lead to the increase in the weight of the member, and the space required for accommodating such a member. In certain applications, such increase in the weight and need for additional space may not be acceptable. For instance, a reinforcement rib may interfere with other components.

In situations where a destructive axial force rarely occurs, and slight deformation of the member can be tolerated, it may be possible to avoid the destruction of the member by reducing the curvature of the curved section or by otherwise controlling the bucking of the curved section, instead of simple reinforcement.

BRIEF SUMMARY OF THE INVENTION

In view of such problems of the prior art, and the recognition by the inventor, a primary object of the present invention is to provide a metallic article having a curved section which can be made resistant to buckling without increasing the cross sectional area of the member or otherwise reinforcing the member.

A second object of the present invention is to provide a metallic article which is slender in shape and provided with a curved section, but resistant to buckling when subjected to an axial compressive force.

A third object of the present invention is to provide a method for manufacturing such a metallic article.

According to the present invention, these and other objects can be accomplished by providing a method for manufacturing a metallic article resistant to buckling, comprising the steps of: preparing a metallic article including a twin deformation system; compressing the metallic article until the twin deformation system is deformed beyond a region of twin boundary deformation; and restoring a part of the twin deformation system which has been deformed beyond a region of twin boundary deformation back to the region of twin boundary deformation so as to produce a first part which is restored to the region of twin boundary deformation, and a second part which is left deformed beyond the region of twin boundary deformation.

When a compressive load is applied to the thus prepared article, and the first part and the second part are both compressed, the first part can deform more readily than the second part so that the overall shape of the article changes as its deformation progresses. Therefore, by appropriately selecting the distributions of the first part and the second part, it is possible to change the shape of the article more suitable for withstanding the load. Typically, the distributions of the first part and the second part are selected such that the bending moment of the vulnerable part is reduced. For instance, the article may be provided with a curved section which deforms into a straight shape when subjected to a chord-wise compression. Typically, the article consists of an elongated member having a curved section therein which has the first part formed on an outside part of the curved section, and the second part formed on an inside part of the curved section. Thus, the article may be made resistant to buckling in spite of the presence of the curved section.

Typically, the twin deformation system is formed in a martensite phase. Such a state can be readily achieved in a Ni—Ti shape memory alloy.

The step of partly restoring the region of twin boundary deformation may comprise a step of bending the metallic article or, alternatively, a step of heating a part of the metallic article. According to yet another embodiment of the present invention, the first part and the second part originally consist of separate members which are processed individually so as to return to the region of twin boundary deformation and stay beyond the region of twin boundary deformation, respectively, and are subsequently joined together.

BRIEF DESCRIPTION OF THE DRAWINGS

Now the present invention is described in the following with reference to the appended drawings, in which.

DETAILED DESCRIPTION OF THE PREFERRED EMBODIMENTS

Figure 5:
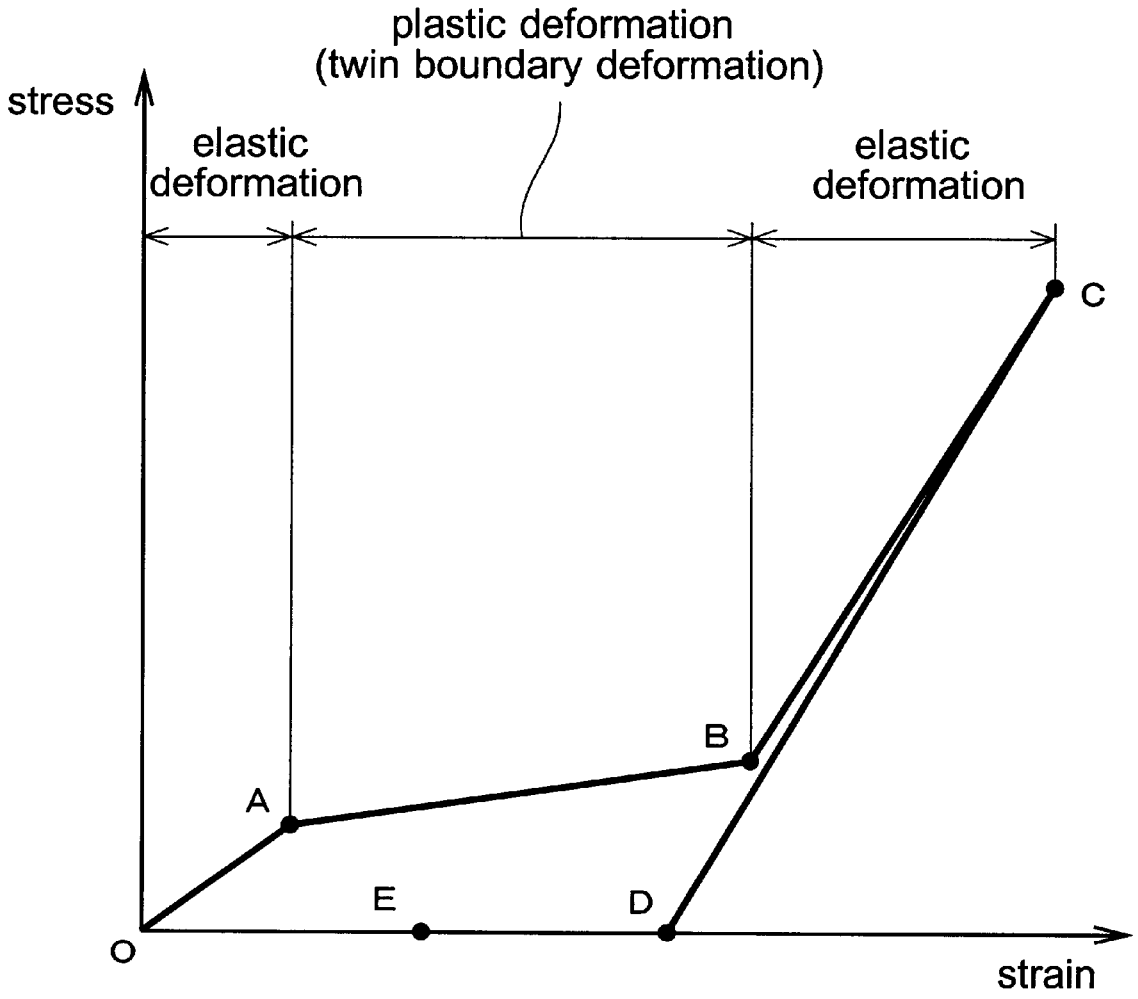
FIG. 5 is a graph showing the relationship between the stress and strain of a material having a twin boundary deformation system.

When a metallic material such an Ti—Ni shape memory alloys having a twin deformation system in a martensite phase is subjected to a progressively increasing stress as illustrated in FIG. 5, it initially goes through a region of normal elastic deformation (curve OA in the graph of FIG. 5), a region of twin boundary deformation which involves permanent deformation with a small resistance (curve AB in the graph of FIG. 5), and a region of high-resistance elastic deformation (curve BC in the graph of FIG. 5). When the stress is removed after entering the region of high-resistance elastic deformation (curve BC in the graph of FIG. 5), because rearrangement of the twin system (dislocation) has progressed in the region of twin boundary deformation (curve AB in the graph of FIG. 5), residual strain remains in the material (point D in the graph of FIG. 5). When the material in this state is subjected to a stress in the direction of the twin boundary deformation, the material undergoes a high-resistance elastic deformation. On the other hand, when the material in this state is subjected to an opposite stress or a stress in the opposite direction to the twin boundary deformation, the residual strain in the material diminishes (point E in the graph of FIG. 5). Thus, when the material is subjected to a tensile stress after completing the twin boundary deformation and entering the region of high-resistance elastic deformation, a low-resistance twin boundary deformation (elongation) occurs.

Therefore, when a member is subjected to a compressive stress beyond the region of twin boundary deformation, and is curved in a perpendicular direction, the outer side of the curved section is subjected to tension, and undergoes a deformation in the opposite direction to the twin boundary deformation. Thus, a permanent deformation (elongation) occurs, and the residual stress diminishes. On the other hand, the inner side of the curved section merely elastically deforms, and involves no change in the mode of deformation. Thus, the curved section is now made up of two layers. The first layer on the outside of the curved section has returned to the region of twin boundary deformation, and capable of low-resistance plastic deformation. The second layer on the inside of the curved section has completed the twin boundary deformation, and is in the region of high resistance elastic deformation.

When a member having a curved section of such a two-layered structure is subjected to a chord-wise compressive force, the first layer of lower resistance deformation on the outside compresses more readily than the second layer of higher resistance deformation so that the curved section deforms into a more straight state. Thus, in effect, the member, although it includes a curved section, demonstrates a mechanical strength against compressive axial stress comparable to that of a member having no curved section.

A member having a similar structure can be manufactured by other methods. One such method is now described in the following. A shape memory alloy which is a type of metallic materials having a twin boundary deformation system can return to the region of twin boundary deformation by applying heat. A member, made of such a shape memory alloy and having a curved section, is first deformed beyond the region of twin boundary deformation, and is thus brought into the region of high resistance elastic deformation. The member is then partly heated so to bring one side of the material back into the region of twin boundary deformation.

According to another possible method, the member is subjected to an uneven stress so that a part of the member is deformed beyond the region of twin boundary deformation while the remaining part of the member is still in the region of twin boundary deformation. The member is then appropriately cut or otherwise shaped so that the member may acquire the two layered structure mentioned above.

Figure 1A:
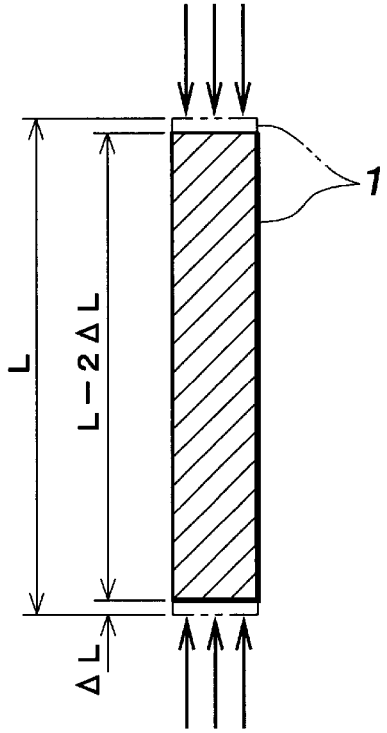
FIG. 1*a* is a schematic side view showing the step of compressing a rod member.
Figure 1B:
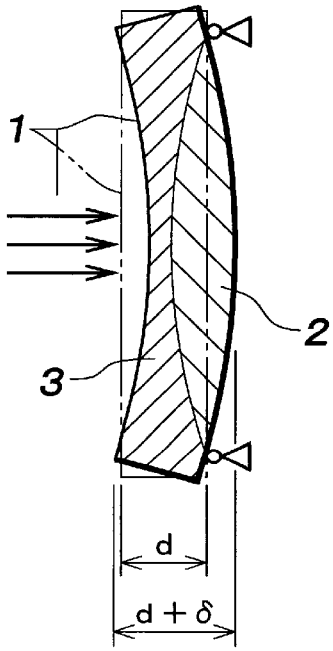
FIG. 1*b* is a view similar to FIG. 1*a* showing the step of bending the rod member.

FIGS. 1*a* and 1*b* illustrate a first method for preparing a member having a curved section according to the present invention. First of all, as illustrated in FIG. 1*a*, a rod member 1 is subjected to an axial compressive load which brings the member beyond the region of twin boundary deformation. Then, the rod member is bent over its entire length by pressing it sideways against a die having a curved profile as illustrated in FIG. 1*b*. These steps of compression and bending take place at a room temperature. This condition corresponds to the low temperature phase of Ti—Ni shape memory alloys.

The compressing step of FIG. 1*a* brings the rod member 1 into the region of high resistance elastic deformation with its length L slightly reduced (by 2ΔL) due to a residual strain λ resulting from the completion of twin boundary deformation. The bending step of FIG. 1*b* causes a tensile stress on the outside of the curvature which at least partly restores the preceding twin boundary deformation while producing a permanent bending deflection δ in the rod member 1. The part of the rod member 1 on the inside of the curvature is compressed even further and stays well beyond the region of twin boundary deformation. Thus, the rod member 1 is given a two-layered structure, a first layer 2 in the region of low resistance twin boundary deformation and a second layer 3 in the region of high resistance elastic deformation. In this case, the tensile stress in the first layer 2 is greater than the compressive stress in the second layer 3 so that the neutral plane offsets from the geometric neutral plane more toward the second layer 3. In other words, the first layer 2 in tension extends deeper into the material than the second layer 3 in compression does.

Figure 2A:
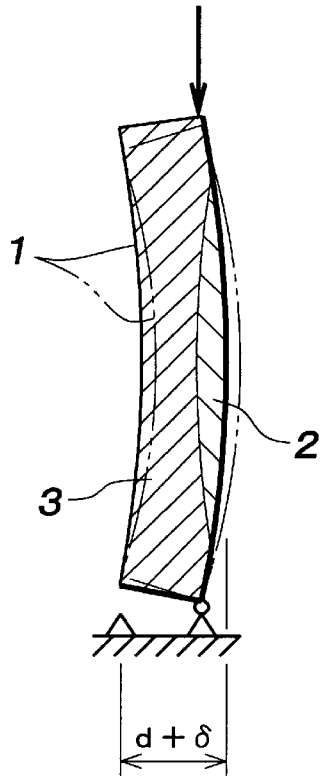
FIG. 2*a* is a view similar to FIG. 1*a* showing the state of the rod member when it is subjected to a chord-wise compressive load.
Figure 2B:
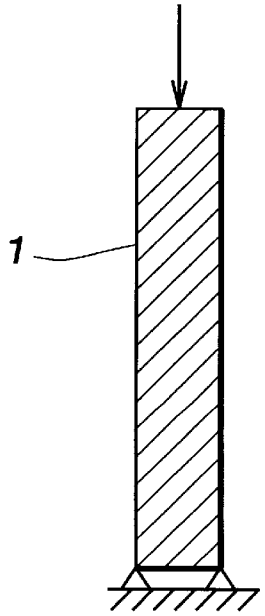
FIG. 2*b* is a view similar to FIG. 1*a* showing the state of the rod member as it demonstrates the tendency to deform into a straight shape.

When this rod member 1 is subjected to a compressive load in the chord-wise direction as illustrated in FIG. 2*a*, because the first layer 2 (the region of low resistance twin boundary deformation) on the outside of the curvature can significantly more readily deform than the second layer 3 (the region of high resistance elastic deformation) on the inside of the curvature, the rod member 1 demonstrates a tendency to deform into a straight shape against the bending moment produced by the compressive load as illustrated in FIG. 2*b*.

Figure 3:
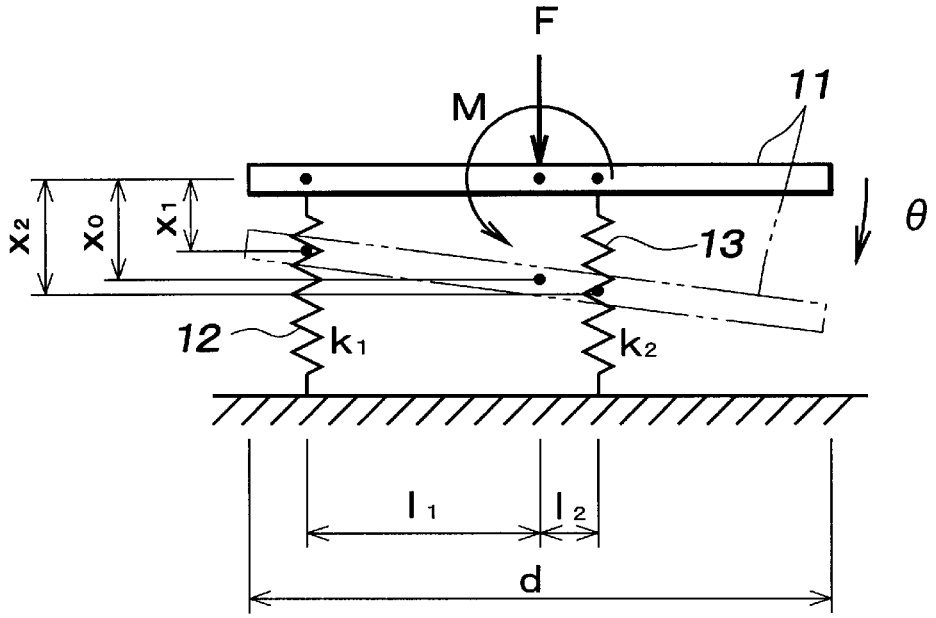
FIG. 3 is a diagram of a model for explaining the principle of the present invention.

FIG. 3 illustrates a model of the rod member 1 for aiding the explanation the principle of the present invention. A rigid beam 11 representing a small section of the rod member 1 is subjected to a chord-wise compressive load F, and a resulting bending moment M. The length of the beam 11 corresponds to the width or the diameter 2 of the rod member 1. The beam 11 is supported by a pair of springs 12 and 13 having spring constants $k_1$, and $k_2$ corresponding to Young's $E_1$ and $E_2$ of the first layer 2 and the second layer 3, respectively. The points of attachment of the springs 12 and 13 to the beam 11 correspond to the middle points of the first and second layers 2 and 3, respectively. The distances between the points of attachment of springs 12, 13 on the beam 11 and the point at which the compressive load F is applied are $l_1$ and $l_2$, respectively.

If the displacements of these points of attachment to the point of application of the chord-wise compressive load F are $x_1$ and $x_2$, and the displacement of the point of force application is $x_0$, the following two equations can be obtained from the equilibrium of forces and moments.

$$-k_1x_1-k_2x_2=F \tag{1}$$

$$-k_1x_1l_1-k_2x_2l_2=M \tag{2}$$

The following relations hold between the rotational angle θ of the beam 11 and the displacement of the various points of the beam.

$$x_1=x_0-l_1\theta \tag{3}$$

$$x_2=x_0-l_2\theta \tag{4}$$

When these relationships (3) and (4) are substituted into Equations (1) and (2), the following equations are obtained.

$$-(k_1+k_2)x_0-(l_1-l_2)\theta=F \tag{5}$$

$$(k_1l_1-k_2l_2)x_0-(l_1^2+l_2^2)\theta=M \tag{6}$$

Figure 4:
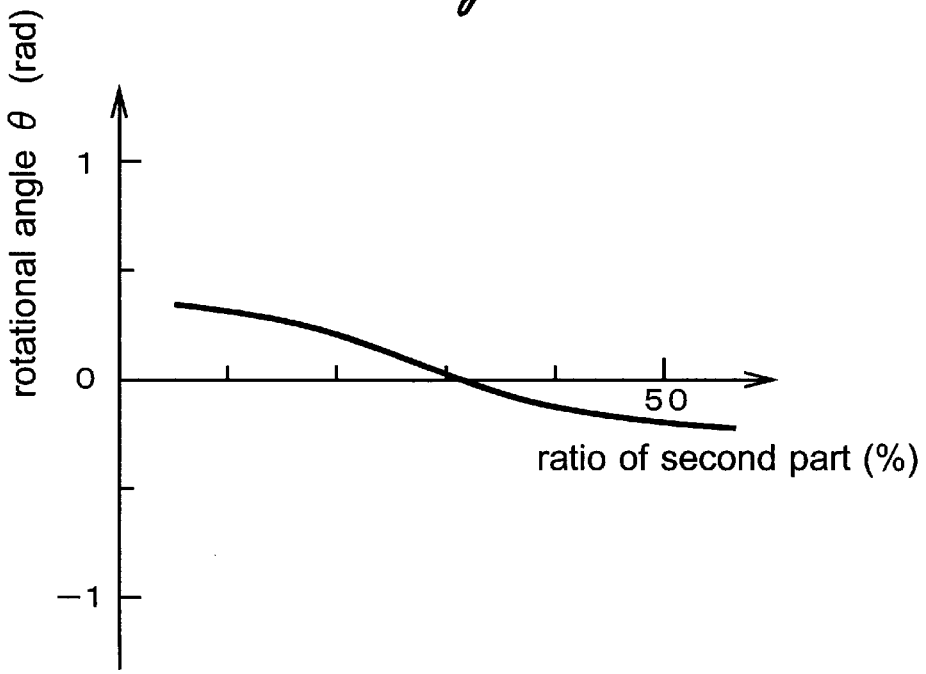
FIG. 4 is a graph showing the relationship between the size of the part of the rod member which has been deformed beyond the region of twin boundary deformation and the rotational angle in the model of FIG. 3.

FIG. 4 is a graph showing the relationship between the rotational angle θ of the beam 11 and the depth ratio of the two layers 2 and 3 when $E_1/E_2=5$ and M=F/2. As shown in FIG. 4, when the ratio of the second layer 3 which has completed the twin boundary deformation to the entire width of the rod member 1 is smaller than a certain value (approximately 30%), the rotational angle θ turns positive. In other words, when the rod member 1 is subjected to a compressive load under this condition, the first layer 2 which is capable of twin boundary deformation deforms more than the second layer 3, and this causes the curvature of the rod member 1 to diminish.

As the deformation of the rod member 1 toward a straight state progresses, the twin boundary deformation in the first layer 2 progresses due to the increasing compressive stress. Therefore, as the curvature of the rod member 1 diminishes, the first layer 2 grows smaller while the second layer 3 grows larger so that the rigidity of the rod member 1 increases in effect. Eventally, the rod member 1 reaches a state in which the twin boundary deformation is fully completed or a state similar to the intermediate state shown in FIG. 2*b* during the manufacturing process is reached, with the result that the rod member 1 demonstrates a high mechanical strength against compressive load.

The above description was directed to a simple rod member 1 having a uniform curvature over its entire length as an example, but the present invention can be applied to members having other different shapes, and more complex curvature distributions. It is also possible to join two members which are prepared separately so as to achieve a single member having a final state sought by the present invention.

An actual exemplary process of preparing a rod member according to the present invention is described in the following. A rod member 1 consisting of a Ti50-Ni40.8-Cu9.9 shape memory alloy was shaped into a cylindrical shape having a length (L) of 35.7 mm and a diameter (d) of 5 mm. This rod member was subjected to a compressive load as illustrated in FIG. 1*a* until a permanent compressive deformation (2 ΔL) of 1.7 mm was produced. Therefore, the total length (L−2 ΔL) was reduced to 34 mm, and this corresponds to a residual strain λ of approximately 5%. The rod member 1 was then bent as illustrated in FIG. 1*b* until a permanent bending deflection (δ) of 2.56 mm was produced.

The rod member 1 thus prepared was tested by placing it under a chord-wise compressive load as illustrated in FIGS. 2*a* and 2*b*. The deflection (δ) was reduced to 1.4 mm, and this straightening deformation was visible even to naked eyes.

Thus, a member having a curved section according to the present invention can resist the tendency to buckle even when subjected to a chord-wise compressive load, and can demonstrate a mechanical strength against such a compressive load comparable to that of a straight member. Therefore, the present invention can allow the use of a member having a curved section in applications where significant chord-wise compressive loads are applied without increasing the cross sectional area of the curved section or otherwise reinforcing the member.

Although the present invention has been described in terms of preferred embodiments thereof, it is obvious to a person skilled in the art that various alterations and modifications are possible without departing from the scope of the present invention which is set forth in the appended claims.

What is claimed is:

1. A method for manufacturing a metallic article resistant to buckling, comprising:

preparing an elongated metallic member including a twin deformation system;

axially compressing said elongated metallic member until said twin deformation system is deformed beyond a region of twin boundary deformation; and restoring a first part of said twin deformation system which has been deformed beyond a region of twin boundary deformation back to said region of twin boundary deformation so as to produce a first part which is restored to said region of twin boundary deformation, and a second part which is left deformed beyond said region of twin boundary deformation.

2. A method according to claim 1, wherein said twin deformation system is formed in a martensite phase.

3. A method according to claim 2, wherein said metallic article comprises a Ni—Ti shape memory alloy.

4. A method according to claim 1, wherein said step of partly restoring said region of twin boundary deformation comprises a step of bending said metallic article.

5. A method according to claim 1, wherein said step of partly restoring said region of twin boundary deformation comprises a step of heating a part of said metallic article.

6. A method for manufacturing a metallic article resistant to buckling, comprising:

preparing a metallic article including a twin deformation system;

axially compressing said metallic article until said twin deformation system is deformed beyond a region of twin boundary deformation; and restoring a first part of said twin deformation system which has been deformed beyond a region of twin boundary deformation back to said region of twin boundary deformation so as to produce a first part which is restored to said region of twin boundary deformation, and a second part which is left deformed beyond said region of twin boundary deformation;

wherein said first part and said second part originally consist of separate members which are processed individually so as to return to said region of twin boundary deformation and stay beyond said region of twin boundary deformation in said restoring step, respectively, and are subsequently joined together.

7. A method for manufacturing a metallic article resistant to buckling, comprising:

preparing a metallic article including a twin deformation system;

axially compressing said metallic article until said twin deformation system is deformed beyond a region of twin boundary deformation; and restoring a first part of said twin deformation system which has been deformed beyond a region of twin boundary deformation back to said region of twin boundary deformation so as to produce a first part which is restored to said region of twin boundary deformation, and a second part which is left deformed beyond said region of twin boundary deformation;

wherein said article consists of an elongated member having a curved section therein which has said first part formed on an outside part of said curved section, and said second part formed on an inside part of said curved section.

* * * * *